United States Patent [19]

Gerson

[11] 4,040,538

[45] Aug. 9, 1977

[54] TEAPOT AND LID COMBINATION

[76] Inventor: Samuel L. Gerson, P.O. Box 1887, Wilmington, Del. 19899

[21] Appl. No.: 687,706

[22] Filed: June 14, 1976

[51] Int. Cl.[2] ..... B65D 1/24; B65D 1/36; B65D 57/00

[52] U.S. Cl. ..... 220/20; 220/69; 220/85 CH; 220/212

[58] Field of Search ..... 220/20, 85, 85 CH, 69, 220/212

[56] References Cited

U.S. PATENT DOCUMENTS

| | | | |
|---|---|---|---|
| 2,496,792 | 2/1950 | Hellberg | 220/212 |
| 3,107,028 | 10/1963 | De Robertis | 220/69 X |

*Primary Examiner*—George T. Hall
*Attorney, Agent, or Firm*—Connolly and Hutz

[57] ABSTRACT

A separate lid for a teapot is removably connected below the bottom of the teapot while it is being washed and stored prior to usage. The top has an unround knob, which is inserted through a corresponding hole in a shelf within the base of a teapot and rotated out of line with it to nest the lid within the base.

5 Claims, 4 Drawing Figures

TEAPOT AND LID COMBINATION

BACKGROUND OF THE INVENTION

Teapots with separate lids used in food service establishments are likely to suffer loss or misplacement of the lids during cleaning and storage. An object of this invention is to provide a teapot and separate lid combination which prevents loss and misplacement of the lid prior to usage.

SUMMARY

In accordance with this invention the lid is stored or stowed within the base of the teapot by removably inserting and latching the lid to a shelf within the base of the teapot. The removable storage and latching is accomplished by inserting an unround knob through a corresponding hole in the shelf and rotating the knob out of line with the hole between short nubs. The lid is thus safely stored within the confines of the pot ready for use when required.

BRIEF DESCRIPTION OF THE DRAWINGS

Novel features and advantages of the present invention will become apparent to one skilled in the art from a reading of the following description in conjunction with the accompanying drawings wherein similar reference characters refer to similar parts and in which.

DESCRIPTION OF THE PREFERRED EMBODIMENT

Figure 1:
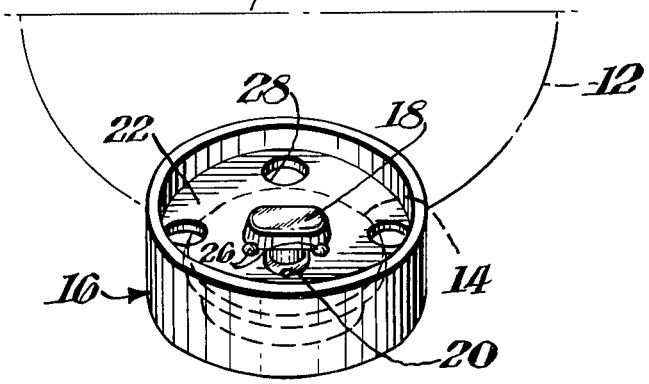
FIG. 1 is a three-dimensional view of the base of a teapot and lid of this invention stored within it with a portion of the body of the teapot shown in phantom outline.

In FIGS. 1–4 is shown a teapot 10 having a body 12 and a separate lid 14. Teapot 10 is for example, made of a ceramic or plastic material. Lid 14 is stored within base 16 of teapot body 12 by insertion of knob 18 within corresponding hole 20 in shelf 22 within base 16. Knob

18 may be of any unround configuration and is, for example, ellipsoidal as is a slightly larger hole 20.

Figure 4:
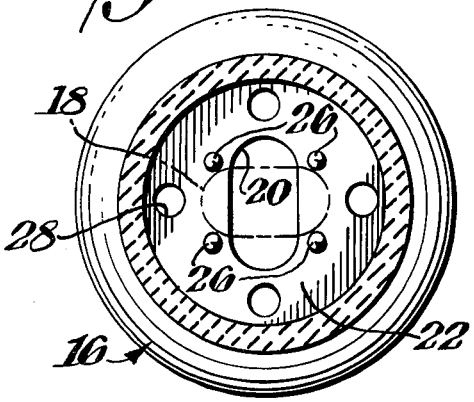
FIG. 4 is a cross-sectional view through FIG. 2 along the line 4—4.
Figure 2:
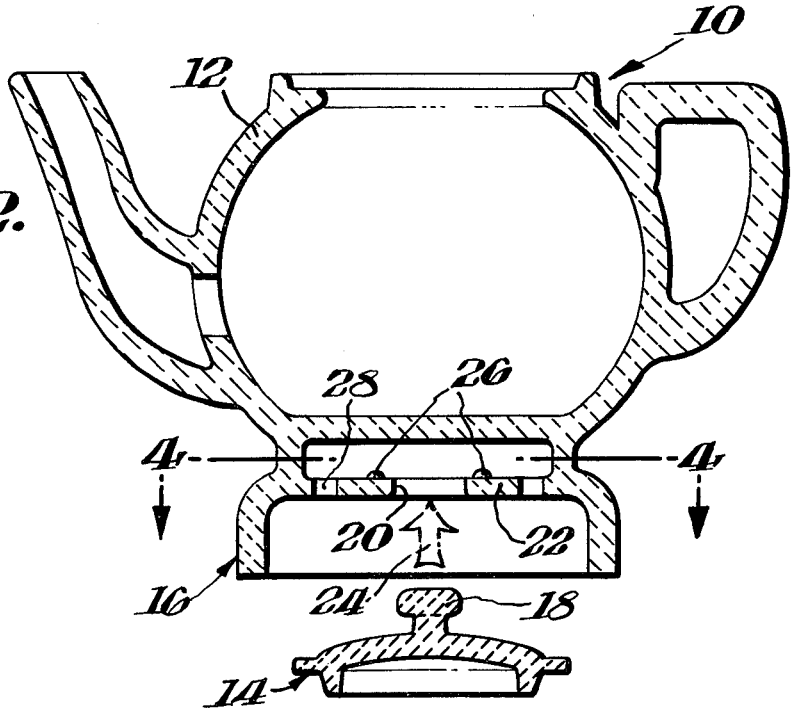
FIG. 2 is a cross-sectional side view in elevation of the teapot and lid of this invention in position for assembly.
Figure 3:
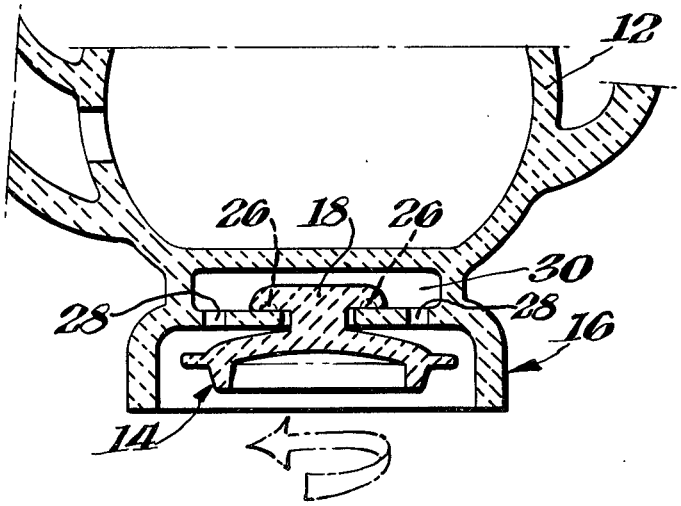
FIG. 3 is a fragmental cross-sectional view in elevation of the teapot and lid of FIG. 2 in their assembled condition.

Lid 14 is inserted for storage or stowage within base 16 as shown in FIG. 2 by insertion of knob 18 in the direction of arrow 24 through hole 20. Lid 14 is then rotated to turn knob 18 out of alignment with hole 20 as shown in FIGS. 1, 3 and 4. In the 90° position of knob 18, relative to hole 20 shown in FIGS. 3 and 4, knob 18 rests between two pairs of nubs 26 protruding a short distance above shelf 22 for removably latching knob 18 in the lids suspending position shown in FIGS. 1, 3 and 4. Holes 28 in shelf 22 permit steam, hot water and air to pass through shelf 22 into internal space 30 when teapot and lid combination 10 are being cleaned, sterilized and stored.

We claim:

1. A teapot body and lid combination comprising a vertically-extending base on the teapot enclosing a space, a shelf means horizontally disposed within the base separating it into the upper and lower spaces, an unround hole substantially in the midportion of the shelf, an unround knob on the lid slightly smaller than the unround hole in the shelf to permit the knob to be inserted through the hole, the unround knob and hole causing the knob to hang on the shelf when it is inserted through it and rotated out of alignment with it, and the lower space in the base being sufficiently large to store the lid within the base when the knob is hung on the shelf.

2. A teapot body and lid combination as set forth in claim 1 wherein nubs are disposed on the shelf within the upper chamber for removably holding the knob in its misaligned position when it is inserted through the hole.

3. A teapot body and lid combination as set forth in claim 1 wherein the knob and hole are ellipsoidal.

4. A teapot body and lid combination as set forth in claim 3 wherein nubs protrude a short distance above the shelf, two pairs of nubs being provided on either side of the 90° misalignment position of the knob of the hole for removably maintaining the knob latched upon the shelf.

5. A teapot body and lid combination as set forth in claim 1 wherein passage holes are provided in the shelf to facilitate washing, sterilizing and drying of the space and stowed lid within the base.

* * * * *